US008955336B2

(12) United States Patent
Wilder et al.

(10) Patent No.: US 8,955,336 B2
(45) Date of Patent: Feb. 17, 2015

(54) TEMPERATURE CONTROL SYSTEM FOR A LIQUID

(75) Inventors: Haim Wilder, Raanana (IL); Rami Ronen, Ramat HaSharon (IL); Eyal Krystal, Kfar Saba (IL); Omri Bar-On, Jerusalem (IL)

(73) Assignee: Strauss Water Ltd., Petach Tikva (IL)

( * ) Notice: Subject to any disclaimer, the term of this patent is extended or adjusted under 35 U.S.C. 154(b) by 330 days.

(21) Appl. No.: 13/394,667

(22) PCT Filed: Sep. 7, 2010

(86) PCT No.: PCT/IL2010/000740
§ 371 (c)(1),
(2), (4) Date: Mar. 7, 2012

(87) PCT Pub. No.: WO2011/030339
PCT Pub. Date: Mar. 17, 2011

(65) Prior Publication Data

US 2012/0167597 A1 Jul. 5, 2012

Related U.S. Application Data

(60) Provisional application No. 61/240,710, filed on Sep. 9, 2009.

(51) Int. Cl.
*F25B 21/02* (2006.01)
*F25D 31/00* (2006.01)
*F25B 21/04* (2006.01)

(52) U.S. Cl.
CPC ..... *F25D 31/002* (2013.01); *F25B 21/02* (2013.01); *F25B 21/04* (2013.01); *F25B 2321/023* (2013.01); *F25B 2321/0252* (2013.01)
USPC ..... 62/3.2; 62/3.64; 62/389

(58) Field of Classification Search
CPC .... F25B 21/02; F25B 21/04; F25B 2321/023; F25B 2321/0252; F25D 31/002
USPC ..... 62/3.2, 3.64, 389; 165/181
See application file for complete search history.

(56) References Cited

U.S. PATENT DOCUMENTS 2,058,098 A * 10/1936 O'Neil et al. ..... 62/167
2,612,357 A * 9/1952 Parks ..... 62/390
2,771,752 A * 11/1956 Tennant ..... 62/224
2,871,675 A * 2/1959 Cornelius ..... 62/258

(Continued)

FOREIGN PATENT DOCUMENTS

CN 1110395 A 10/1995
CN 1118059 A 3/1996

(Continued)

*Primary Examiner* — Mohammad M Ali
(74) *Attorney, Agent, or Firm* — Browdy and Neimark, PLLC

(57) ABSTRACT

A temperature control system (400) for a liquid comprises two sets of temperature control elements oppositely disposed to one another and define between them a temperature control zone. A conduit system within the temperature control zone defines a liquid flow path (300, 302) that is configured to have one or more first segments in proximity to and in heat-conducting association with one of the two sets and one or more second segments in proximity to and in heat-conducting association with the other of the two sets. The temperature control system (400) may be used as a liquid cooling or heating module in a cold liquid dispensing device or system, such as a drinking water or other beverage dispensing device.

14 Claims, 10 Drawing Sheets

(56) References Cited

U.S. PATENT DOCUMENTS

| | | | | |
|---|---|---|---|---|
| 3,982,406 | A * | 9/1976 | Hanson et al. | 62/339 |
| 4,313,491 | A * | 2/1982 | Molitor | 165/83 |
| 4,617,807 | A * | 10/1986 | Pritchett et al. | 62/399 |
| 4,664,292 | A | 5/1987 | Jeans | |
| 5,209,069 | A | 5/1993 | Newnan | |
| 5,285,718 | A | 2/1994 | Webster et al. | |
| 5,501,077 | A | 3/1996 | Davis et al. | |
| 5,634,343 | A | 6/1997 | Baker, III | |
| 6,237,345 | B1 | 5/2001 | Kalman et al. | |
| 6,370,884 | B1 * | 4/2002 | Kelada | 62/3.64 |
| 2001/0040174 | A1 * | 11/2001 | Simmons et al. | 222/129.1 |
| 2003/0101735 | A1 * | 6/2003 | Teague et al. | 62/70 |
| 2003/0188540 | A1 | 10/2003 | Van Winkle | |
| 2004/0025516 | A1 | 2/2004 | Van Winkle | |
| 2004/0068995 | A1 * | 4/2004 | Bethuy et al. | 62/139 |
| 2005/0056047 | A1 * | 3/2005 | Carmichael et al. | 62/457.5 |
| 2006/0075761 | A1 | 4/2006 | Kitchens et al. | |
| 2006/0096300 | A1 | 5/2006 | Reinstein et al. | |
| 2006/0150637 | A1 | 7/2006 | Wauters et al. | |
| 2006/0169720 | A1 | 8/2006 | Vipond | |

FOREIGN PATENT DOCUMENTS

| | | | |
|---|---|---|---|
| JP | 2001031198 | A | 2/2001 |
| JP | 2001348093 | A | 12/2001 |
| RU | 2121635 | C1 | 11/1998 |
| RU | 2154782 | C2 | 8/2000 |
| WO | WO 9707369 | A1 | 2/1997 |

* cited by examiner

TEMPERATURE CONTROL SYSTEM FOR A LIQUID

FIELD OF THE INVENTION

This invention relates to a temperature control, e.g. cooling system for a liquid, useful, for example, in device for dispensing of beverages, e.g. cooled drinking water.

BACKGROUND OF THE INVENTION

A variety of liquid cooling systems are known. In some systems peltier units are used. Peltier units are generally more efficient than compressors in terms of energy consumption, but have a smaller cooling capacity.

US 2006/0075761 describes an apparatus for cooled or heated on demand drinking water having a thermal accumulator with embedded serpentine fluid conduit, a network of independently controlled thermoelectric heat transfer modules, and a network of temperature control modules. A preferred embodiment includes the thermal accumulator as a single die-cast thermally conductive metallic medium free of seams and an embedded pipe free of coupling structure.

WO1997007369 describes a cooling unit, suitable for a soft drinks machine or like liquid dispenser, which is compact and can cool the liquid fast enough to be acceptable in a demand-led arrangement and yet not cool it so much that it actually freezes. This application suggests the use of a cooling system that utilizes a combination of a heat pump (typically a Peltier-effect device) with an output matched to the thermal characteristics and desired throughput rate of the liquid to be dispensed coupled with—and directly cooling—an ambient medium in the form of a liquid/solid phase-change material operating in the required temperature range (which will usually be from just above 0° C. to around +5° C. This considerably reduces the possibility of over-cooling the liquid. Secondly, the application suggests a temperature-sensitive switching device, such as a thermistor thermally coupled to the liquid/solid phase-change material (15) and operatively linked to the heat pump so as to effectively control the pump on or off as required.

U.S. Pat. No. 5,634,343 describes a thermo-electric cooler capable of cooling fluid down to below 10° F. The described cooler maximizes the heat transfer path to allow better heat conductivity, and provides a space within the cooler to accommodate the thermal contraction and expansion of the cooling elements.

U.S. Pat. No. 5,285,718 describes a combination beverage brewer with cold water supply within a housing, to furnish a beverage brewing segment, at one or more locations within a housing, and a water chilling or cooling supply disposed in association therewith, to supply cold water as required. The cold water segment of the apparatus includes a cold water tank, a cooling rod therein, cooling module for operating as a heat pump for extracting warmth from the water to heat it, and delivery of the extracted heat to a heat sink, for dissipation. Various electronic and electrical controls are provided for regulating the operations of the various components of the device, and a filtering device is included for filtering the incoming water, and is coupled with various indicators for instructing when filter service is required, or the capacity of the apparatus has reached the processing of a maximum quantity of water.

US2003188540 describes a fluid cooling device for a beverage dispenser that includes: (a) a fluid accumulation vessel; and (b) a bank of thermoelectric devices provided on at least one external surface of the accumulation vessel and having cooling and heating surfaces, where the cooling surfaces are in thermal communication with the fluid accumulation vessel such that when power is supplied to the devices, the cooling surfaces decrease the thermal energy of the fluid within the accumulation vessel.

The following patents and patent applications also disclose beverage dispensers which rely, at least in part, on peltier cooling mechanisms: US 2006/096300; U.S. Pat. No. 5,501,077; U.S. Pat. No. 6,237,345; US 2006/169720; U.S. Pat. No. 5,285,718; U.S. Pat. No. 5,209,069; U.S. Pat. No. 4,664,292; US 2006/096300; U.S. Pat. No. 5,501,077 and U.S. Pat. No. 6,237,345.

SUMMARY OF THE INVENTION

Provided by the invention is a temperature control system for a liquid. The system comprises two sets of temperature control elements, each comprising one or more such elements, oppositely disposed to one another and define between them a temperature control zone. A conduit system within the temperature control zone defines a liquid flow path that is configured to have one or more first segments in proximity to and in heat-conducting association with one of the two sets and one or more second segments in proximity to and in heat-conducting association with the other of the two sets. The temperature control system may be used as a liquid temperature control module in a temperature-controlled liquid dispensing device or system, such as a device for dispensing drinking water or other beverage dispensing device.

The invention provides, by one of its embodiments, a liquid temperature control system for cooling or heating a liquid while it flows through the system. The flow may be from a source to an outlet or may be circulating flow out of and back into a reservoir that maintains an amount of heat controlled liquid, either cooled or heated, for later use. According to a preferred embodiment the liquid is potable water to be dispensed from a dispensing outlet. The temperature control system may be incorporated, for example, in potable water dispensing apparatuses or devices. The temperature control system of the invention has design features that improve efficiency of temperature control of the liquid. Such features comprise serpentine flow of the liquid through the temperature control zone; and having segments that are in heat-conducting association with one set of temperature control elements and others with heat-conducting association with another set of temperature control elements.

The term "temperature control" is used herein to refer to either heating or cooling.

The liquid temperature control system of an embodiment of the invention comprises a first set of one or more temperature control elements oppositely disposed to a second set of one or more temperature control elements. These two sets define between them a temperature control zone which accommodates a conduit system that defines a liquid flow path that is configured to have one or more first segments that are in proximity to and in heat-conducting association with said first elements and one or more second segments that are in proximity to and in heat-conducting association with said second elements.

In some embodiments of the invention the conduit system defines a single flow path through the temperature control zone leading from a liquid inflow to a liquid outflow. In other embodiments the conduit system defines two or more flow paths linking the inflow and outflow. By some embodiments of the invention the flow path has a serpentine geometry.

The term "temperature control element" is used herein to denote an element that can transfer heat or cold, either locally generated in the element as in a peltier element or heat or cold transported from a heating or refrigeration unit, e.g. via a circulating temperature transport fluid.

In some embodiments the liquid temperature control system of the invention is intended for cooling a liquid. A system of this embodiment will be referred to as "liquid cooling system". In other embodiments the liquid temperature control system is a liquid heating system intended for heating the liquid. In still other embodiments the system of the invention may be hybrid liquid heating/cooling system that can change from a cooling mode to a heating mode.

The term "temperature control zone" is used herein to denote a zone that is defined by the temperature control elements and heated or cooled thereby. The temperature control zone may be a zone flanked or surrounded by the heat control elements.

In the context of the liquid cooling system embodiment the temperature control-element and the temperature control zone may be referred to as the "cooling element" and the "cooling zone", respectively.

The term "conduit system" is used herein to denote, in particular, a system of pipes, channels or other conduits that are part of a flow path of a liquid to be heated or cooled that is accommodated within the temperature control zone. The conduit system may be composed of pipe or groove-like segments.

The term "heat-conducting association" is meant to denote a physical association that permits transport of heat (or cold) between the associated media, e.g. between the cooling element and the conduits. The term "thermal communication" may also be used occasionally to relate to such heat transfer association.

The terms "first" and "second" are used herein for convenience of description and do not have any structural or functional significance. The sets, segments, etc. that are qualified as "first" and "second" may be the same or may be different from one another.

The temperature control system of the invention thus includes a conduit system that is being heated or cooled (as the case may be) by the temperature control elements. The conduit system is associated in a thermally conductive manner with the temperature control elements; namely the temperature control elements heat or cool the conduit system to thereby change the temperature of the liquid flowing through it. The conduit system has segments that include such that are in proximity to and in heat-conducting association with the first set of temperature control elements and others that are in such heat-conducting association with said second set.

According to one preferred embodiment the conduit system is configured such that at least some, and at times all, of the first and the second segments are arranged in an alternating manner along the flow path. Consequently the liquid to be cooled flows in a segment adjacent the first set of elements, then in a segment adjacent the second set of elements and so forth.

According to one embodiment of the invention the temperature control element is a thermoelectric cooling element, such as a planar Peltier element having opposite cold and hot faces. While a peltier element may be used also in the case of a liquid heating system of the invention, it is applicable in particular for use in a liquid cooling system of the invention (the cold faces of the Peltier element then line the cooling zone). However, the invention is not limited to the use of such cooling elements and other cooling arrangements are also possible. An example of another cooling arrangement is one making use of a refrigeration unit that cools a coolant fluid which is then transported to said cooling element. A heat element useful in a liquid heating system of the invention may, for example, be a Joule heating element (also known as an resistive heating or ohmic heating element).

By one embodiment the cooling system of the invention comprises a first set of one or more Peltier elements disposed at one side of the cooling zone and a second set of one or more Peltier element disposed at an opposite side of the cooling zone. The Peltier elements of said first set may be the same or may be different than the Peltier elements of the second set. Furthermore, the different Peltier elements within a set may all be the same or may be different (of a different shape or size, different power and different cold generating capacity, etc.).

According to one embodiment, the conduit system includes pipes, made of a heat conducting material, typically metal, with a number of segments that extend through the cooling zone. The system of this embodiment comprises a first group and a second group of tubular conduit segments made of a heat conducting material. The segments of the first group are proximal to and in heat-conducting association with temperature control elements of the first set and the second group are proximal to and in heat-conducting association with temperature control elements of the second set.

The term "tubular conduit" refers to a pipe or other type of a liquid duct with hollow interior having circular, ellipsoid, polygonal, irregular or non-symmetrical or any other type of a cross-section.

The tubular conduits have typically a rectangular cross-section. In one embodiment the conduits are flattened.

Typically each segment spans a length of the temperature control zone. Different segments are in fluid communication with one another whereby the liquid flows repeatedly through the temperature control zone. The flow path is typically constructed to have alternating segments of the first group and those of the second group whereby in its flow path the liquid alternatively flows through a segment adjacent to and in heat-conducting association with one set of temperature control elements and then through a segment adjacent to and in heat-conducting association with the other set of temperature control elements. By one embodiment, ends of the tubular segments are fitted into one or more connector elements that define within them flow paths that link said segments (namely provide for flow communication between segments).

By one embodiment the temperature control zone includes a heat-exchange chamber with liquid inlet and outlet that is defined between a first heat-conducting wall disposed in heat conducting association with the first set of temperature control elements, a second heat conducting wall disposed in heat conducting association with the second set of temperature control elements and between side walls. The heat conducting walls are typically made of metal. An arrangement of channels is formed within the chamber defining one or more continuous flow paths leading from the inlet to the outlet. A first group of one or more of said channels are adjacent to and in heat-conducting association with said first wall and a second group of one or more of said channels are adjacent to and in heat-conducting association with said second wall.

For such heat conducting association the channels may be formed so that one face of the channel is constituted by a portion of one of the heat conducting walls.

The channels may be arranged as interlinked segments of a three-dimensional curvilinear flow path. In some embodiments of the invention at least some of channels of the first group are alternatively arranged along the flow path with channels of the second group.

By one embodiment the channels are formed by dividing panels disposed within the chamber.

The heat conducting walls are, typically, essentially parallel to one another. By one embodiment the heat-exchange chamber comprises a main divider panel disposed in between the two heat-conducting walls and extending essentially parallel thereto to thereby divide the chamber into a first compartment adjacent the first wall and a second compartment adjacent the second wall. Each of the two compartments is further divided by auxiliary panels extending from the main divider panel to the heat conducting walls and defining substantially U-shaped channel segments with two ends. Opening are formed in the main dividing panels to link ends of U-shaped channel segments in the first compartment with ends of a U-shaped channel segments in the second compartment to thereby form a flow path of the U-shaped channel segments from the inlet to the outlet. Consequently, the flow path is constituted by alternating U-shaped channel segments of one compartment and those of the other.

In accordance with the invention the main divider panel, the auxiliary divider panels and the side walls are made from a single block of material.

In the case of a liquid cooling system of the invention, where the temperature control elements are one or more thermoelectric elements, the system may comprise a heat sink arrangement for transport and dissipation of heat generated by said elements. The heat sink arrangement may comprise a closed-circuit heat transport conduit system containing a coolant fluid (which may be a liquid or a gas) fitted between a heat absorption module that is in a heat-transfer association with the one or more thermoelectric elements and a heat dissipation module. The coolant fluid circulates between the heat absorption module and the heat dissipation module to thereby remove the heat generated by said elements. The heat sink arrangement may typically include two heat absorption modules one associated with the first set of cooling thermoelectric elements and one with the second set of cooling thermoelectric elements.

Also provided by the invention is a liquid (e.g. beverage or drinking water) dispensing device comprises said temperature control system. An example is a drinking water dispensing device with a liquid cooling system and/or a liquid heating system in accordance with the invention. At times, more than one liquid cooling and/or heating systems of the invention may be included in a single device, either arranged in series whereby the liquid to be cooled or heated flows in a series of two or more such systems; or arranged in parallel flow paths.

BRIEF DESCRIPTION OF THE DRAWINGS

In order to understand the invention and to see how it may be carried out in practice, embodiments will now be described, by way of non-limiting example only, with reference to the accompanying figures. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. The attached figures are:

FIGS. 4A and 4B and 5A and 5B are schematic representations of exemplary flattened pipes depicting W: H aspect ratios according to different embodiments of the invention, wherein FIGS. 4A and 4B show an example where all have the same cross-section while FIGS. 5A and 5B show an example where different pipes have different cross-sections;

FIGS. 14A, 14B and 14C show the heat absorption module, wherein FIG. 17A is a cross-section through same plane VIII-VIII in FIG. 11, while FIGS. 14B and 14C are perspective views of the module's two main elements.

DETAILED DESCRIPTION OF EMBODIMENTS

Embodiments of the invention relate to liquid temperature control system. While the embodiment described below concern liquid cooling systems, the described principles can be applied equally (mutatis mutandis) to heating.

The principles and operation of a temperature control system according to exemplary embodiments of the invention may be better understood with reference to the drawings and accompanying descriptions.

Before explaining at least one embodiment of the invention in detail, it is to be understood that the invention is not limited in its application to the details set forth in the following description of specific embodiments. The invention encompasses also a myriad of other embodiments and may be practiced or carried out in many ways. Also, it is to be understood that the phraseology and terminology employed herein is for the purpose of description and should not be regarded as limiting.

Figure 1:
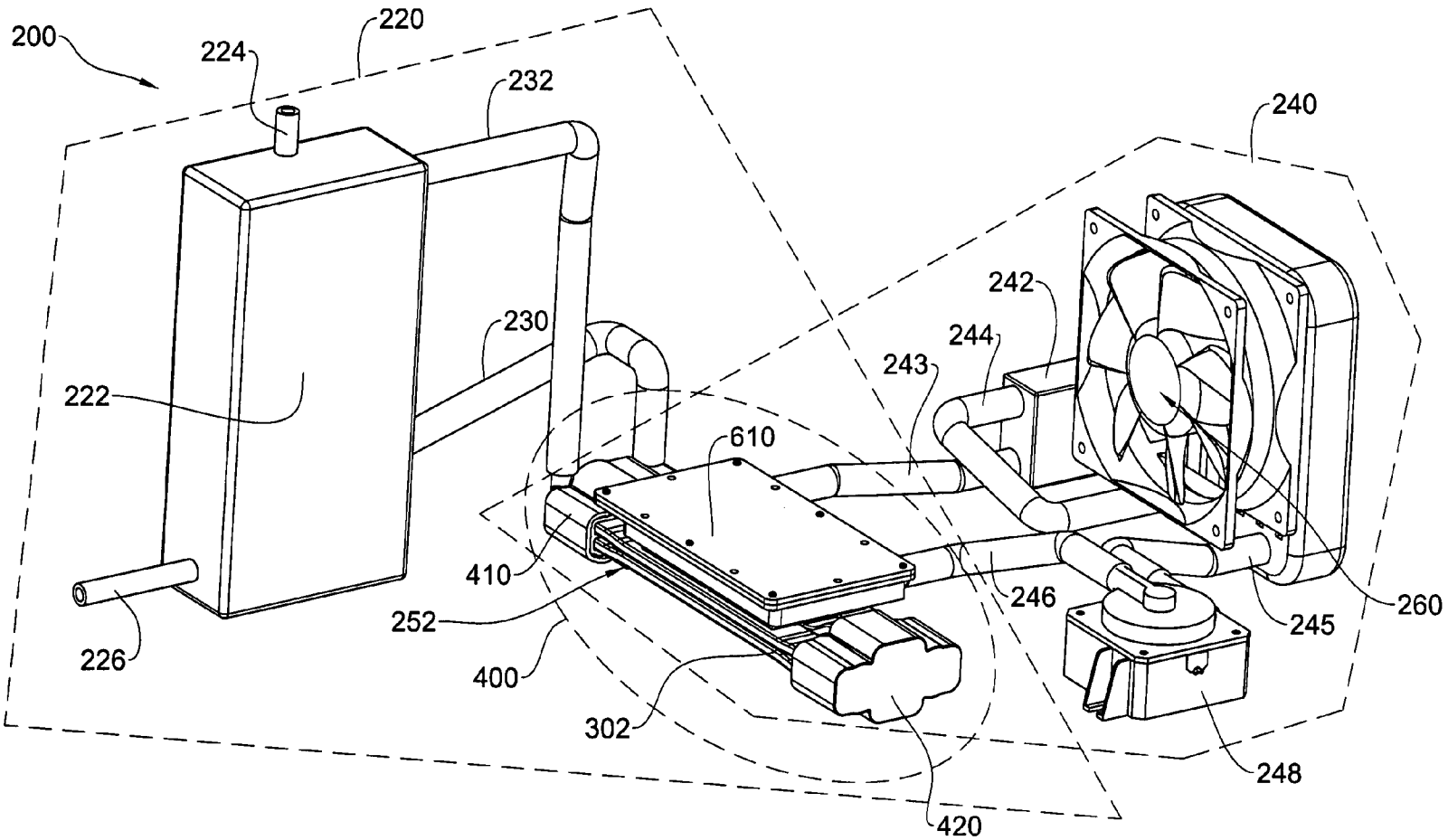
FIG. 1 is a perspective view of an exemplary liquid cooling system according to some embodiments of the invention.

Referring now to FIG. 1, shown is a schematic representation of an exemplary cooling apparatus 200 amenable for installation, for example, in a "cold water on demand" dispenser. Apparatus 200 includes a liquid management components generally designated 220, a temperature control system 400 that is associated with a heat sink arrangement 240.

Figure 2:
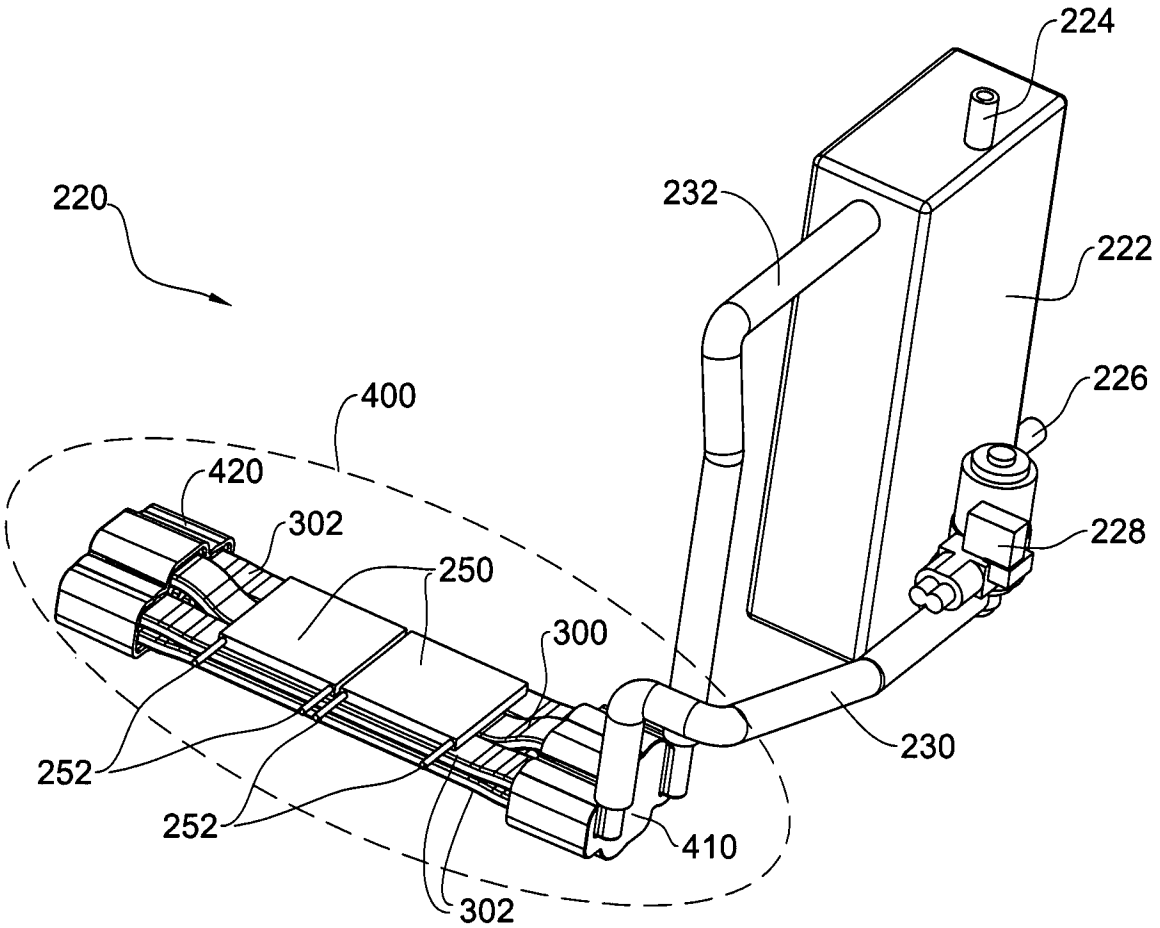
FIG. 2 is a perspective view of the conduit system and the associated liquid flow elements.

FIG. 2 depicts the liquid management components 220 in greater detail. Specifically Peltier thermoelectric cooling elements 250 are visible mounted in direct thermal communication with the upper three of six flattened pipes 300 and 302. There are also corresponding elements that are mounted in direct thermal communication with the lower three of said flattened pipes. In the depicted exemplary embodiment, which is configured for cooling, electric leads 252 are connected to a power source (not pictured) so that a cold side of Peltier elements 250 contacts pipes 300 and/or 302. A hot side of Peltier devices 250 faces upwards in the drawing. Depicted exemplary liquid management components also include a reservoir 222, a reservoir inlet 224 and a pump 228. During use pump 228 circulates water through pipes 230 and 232 so that there is an exchange between reservoir 222 and temperature control system 400. Chilled water can be drawn from reservoir 222 via exit port 226.

Referring again to FIG. 1, Peltier thermoelectric cooling elements 250 (FIG. 2B) and the opposite one (not shown) define between them a cooling zone 252 that accommodates the flattened pipes 230 and 232. Element 250 and its opposite ones are mounted in direct thermal communication with flattened pipes 300 and 302 and serve to cool fluid flowing through the pipes. The thermoelectric cooling element is a in thermal communication with the heat absorption module 610 and its counterpart (not shown) associated with the opposite thermoelectric elements. Module 610 is cooled by a supply of coolant fluid. The coolant fluid flows from reservoir 242 via pipe 243 to an inner lumen of module 610 and out through pipes 246 and 345 to a heat dissipation unit (depicted as fan 260) and back to reservoir 242 for recirculation. Cooling fluid pump 248 may be installed at any point in the recirculation path.

In other exemplary embodiments of the invention, module 610 is cooled by a flow of cooling fluid which is not recycled.

Figure 3:
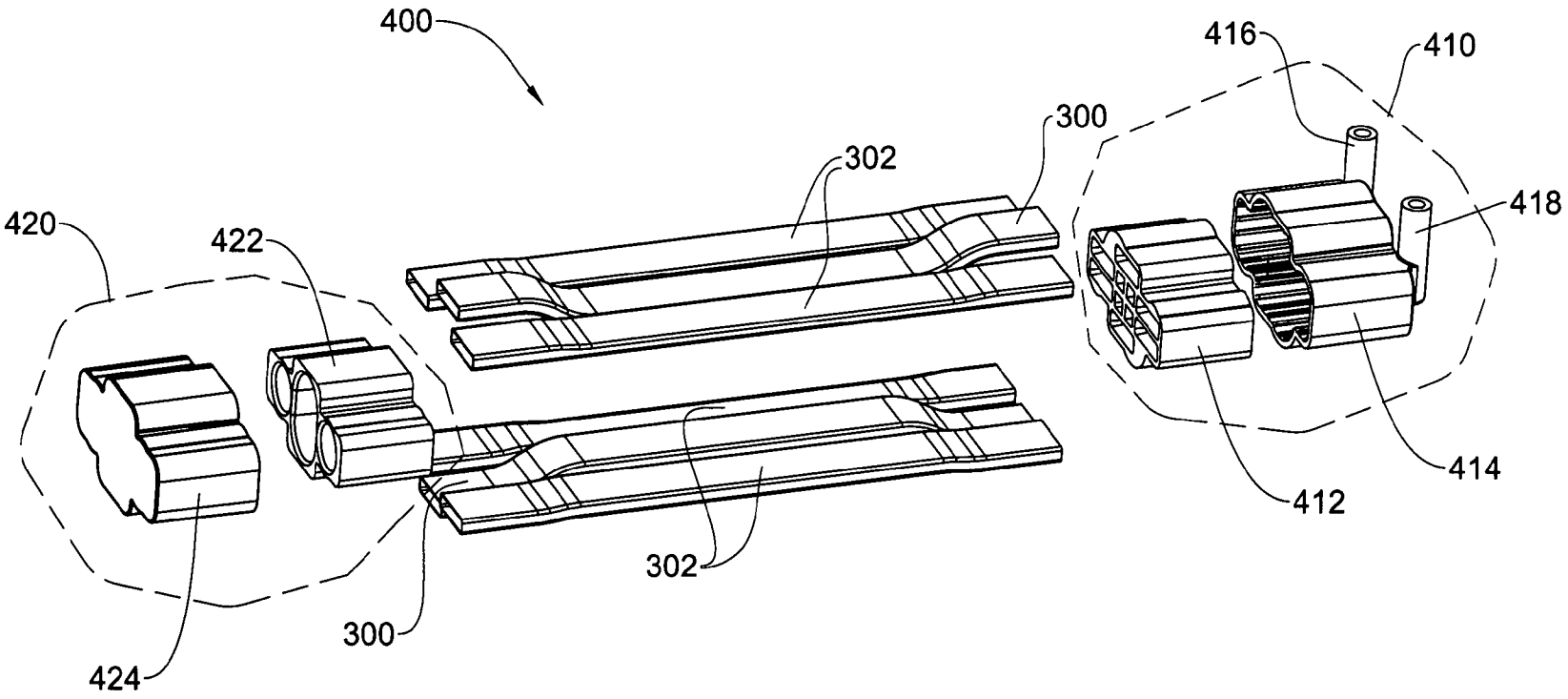
FIG. 3 is an exploded view of the conduit system of FIG. 2.

FIG. 3 is an exploded view of an exemplary conduit system 402 that defines a liquid flow path between inlet port 416 and outlet port 418. It includes a plurality of flattened pipe segments (six in this exemplary embodiment) 300 and 302. In the depicted embodiment, pipes 302 are connected in series so that their inner lumens form a continuous flow path.

An exemplary connector element 410 includes a fluid inlet port 416 and a fluid outlet port 418. Connector element 410, composed of an inner connector element 412 and an outer connector element 414, is one exemplary way to provide flow communication between inner lumens of pipes 300/302. Each of these ports is in flow communication with an inner lumen of one of the pipes. Connector element 420 is provided at the other end of the pipe segments, having an inner connector element 422 and an outer connector element 424. The flow path through pipes 300/302 is a continuous serpentine path from port 416 to 418 through the six depicted pipes 300 and 302 and caps 410 and 420. The flow communication between ports 416 and 418 and one of the pipe segments and between the pipe segments is provided through appropriate channeling arrangements within the connector elements 410 and 420.

Figures 4A, 4B, 5A, 5B:
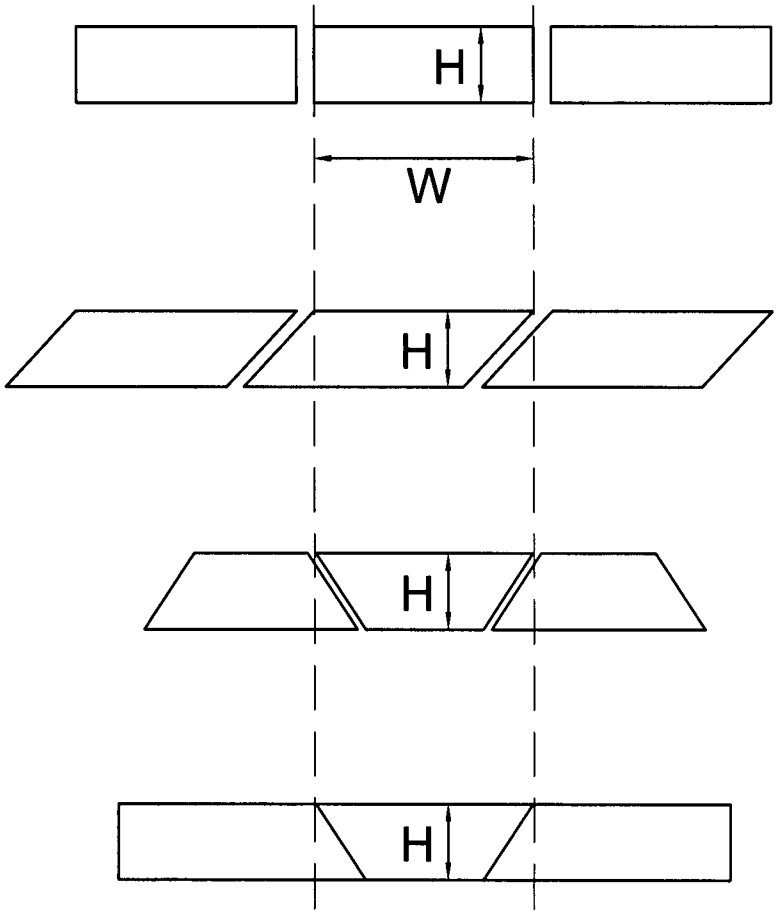

In some exemplary embodiments of the invention, flattened pipe segments 300,302 have an inner lumen characterized by a Width to Height (W:H) aspect ratio of at least 2:1. Optionally, increasing W provides more surface to contact Peltier unit 250. Although FIG. 4 depicts pipes 300 and 302 as substantially rectangular in cross section, FIGS. 4A, 4B, 5A and 5B show that a large W:H ration can be achieved using other cross sectional shapes.

According to different exemplary embodiments of the invention, the continuous flow path through lumens of the pipes, provided through the channeling arrangement in the connector elements, can be configured differently.

Figure 6A:
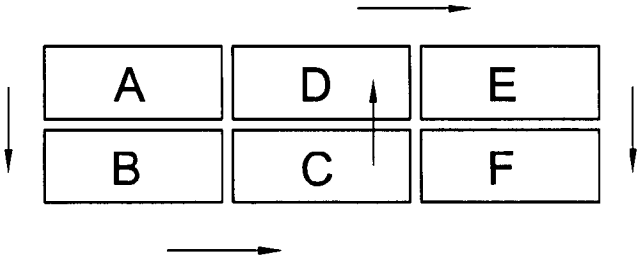
FIGS. 6A, 6B and 6C are schematic representations of exemplary flow paths through a group of six flattened pipes according to different embodiments of the invention.
Figure 6B:
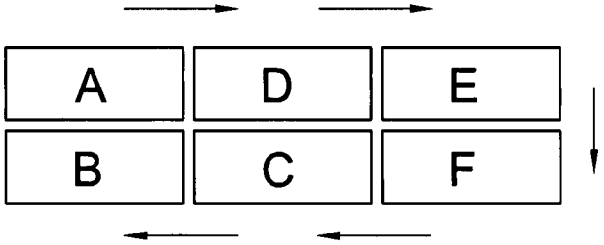
Figure 6C:
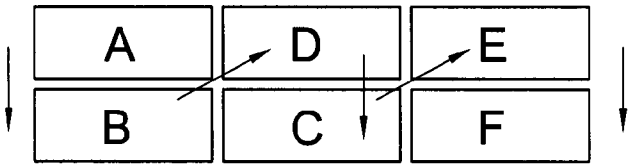
Figure 7:
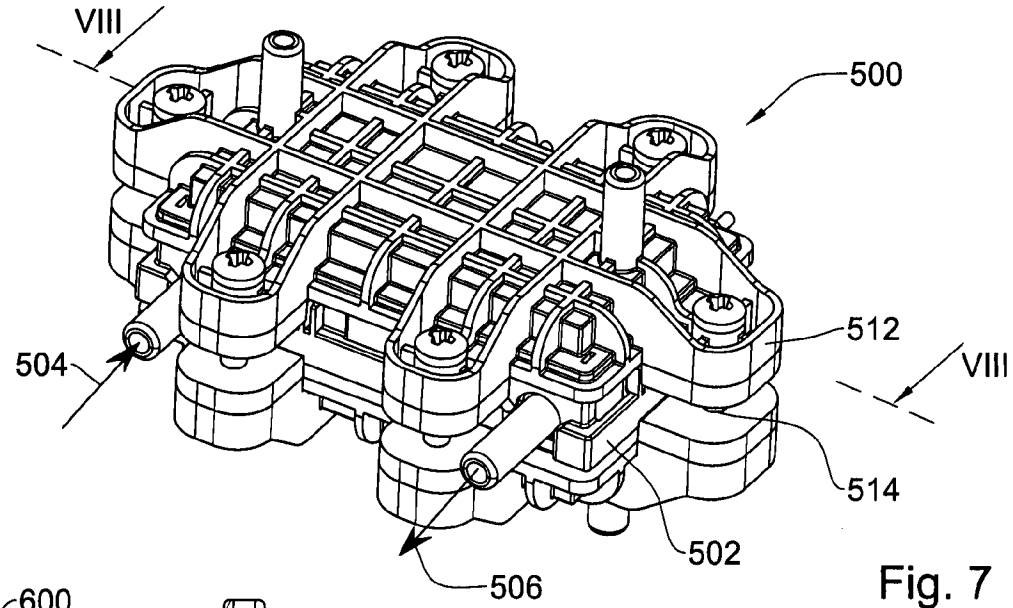
FIG. 7 is a perspective view of a liquid cooling system in accordance with an embodiment of the invention.

FIGS. 6A, 6B and 6C depict three exemplary flow paths through an arrangement of six pipes shown in schematic cross-section. There three exemplary flow paths are depicted by arrows in a self-explanatory manner.

Another embodiment of the invention will now be described with reference to FIGS. 7-14C.

Figure 8:
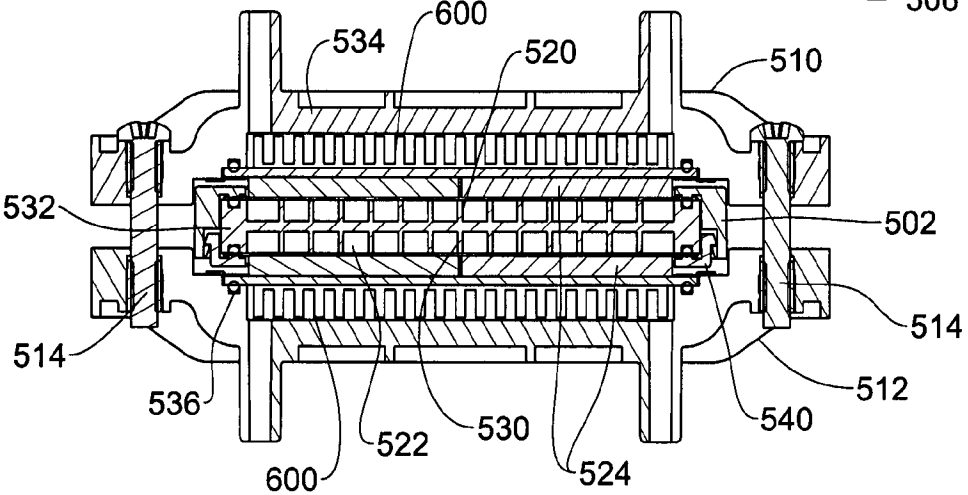
FIG. 8 is a cross-section through plane VIII-VIII in FIG. 7.
Figure 9:
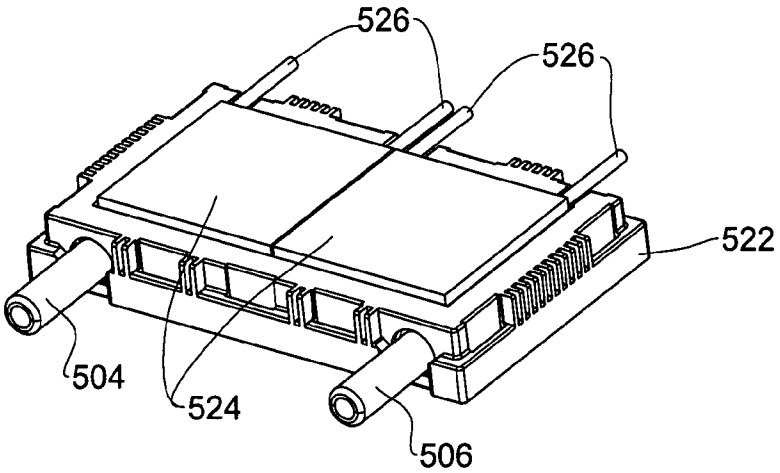
FIG. 9 shows the cooling system of FIG. 7 with the heat sink block removed, depicting the heat exchange chamber with associated peltier elements.
Figure 10:
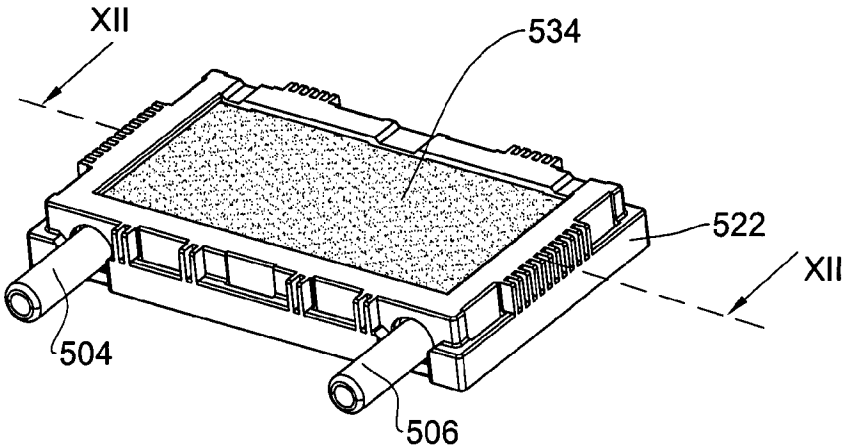
FIG. 10 shows the heat exchange chamber with the frame that houses it.

The liquid cooling system 500 includes a temperature control module 502, with a liquid inlet 504 and a liquid outlet 506, flanked by two heat-absorption modules 510 and 512, all components held together and held together by screws 514. As can be seen in FIGS. 8 and 9, disposed between each of modules 510 and 512 and module 502 are two sets of cooling elements 520 and 522, each, in this exemplary embodiment, including two Peltier elements 524, with associated electric leads 526, connected to powering module (not shown). It should be noted that sets with two Peltier elements are but an example and the sets of cooling elements may include one or any number of a plurality of Peltier elements. In this particular example all Peltier elements are the same, it being understood that in some other embodiments the Peltier elements may differ from each other in their shape, dimension, as well as in their cooling capacity.

The two sets of cooling elements define between them a cooling zone 530, accommodating a heat exchange chamber 532. The liquid inlet 504 and outlet 506 are in flow communication with the interior of chamber 532.

The chamber 532 is defined between first and second heat conducting walls 534 and 536 and side walls 538 and 540 that are integral part of the channel-forming block 550, shown in FIGS. 13A-13C and that will be described further below.

Figure 11:
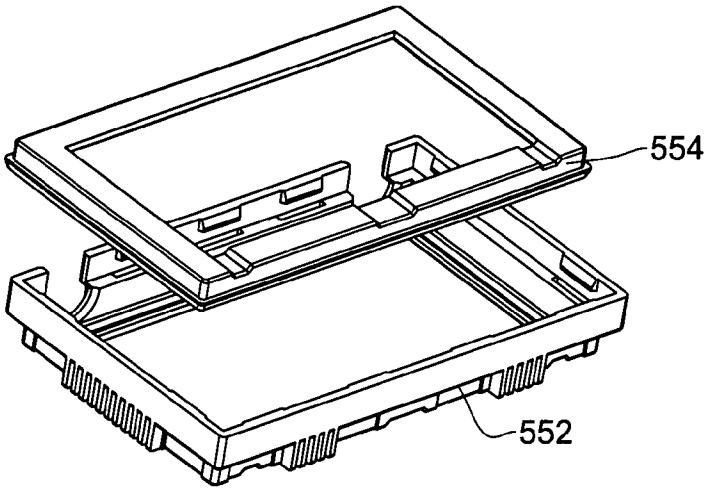
FIG. 11 is an exploded view of the frame that houses the heat-exchange chamber.
Figure 12:
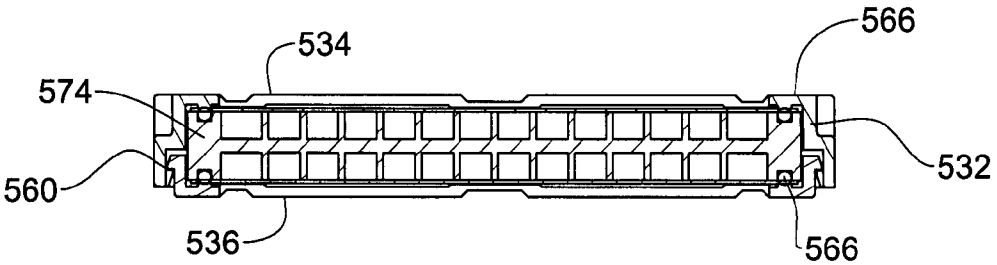
FIG. 12 is a cross-section through plane XII-XII in FIG. 10.

The channel-forming block 550 and the two heat-conducting walls 534,536 are held together by two frame elements 552 and 554 that are seen in an exploded view in FIG. 11 and that are snap-assembled by cooperating fastening members designated collectively as 560. Channel-forming block 550 has two circumferential grooves 562 and 564, one on each side, which accommodate O-rings 566, 568. As can best be seen in FIG. 12, a fluid-tight engagement is obtained between the walls 534,536 and the block 550 to thereby defined a confined fluid-tight chamber within the block 550.

Figure 13A:
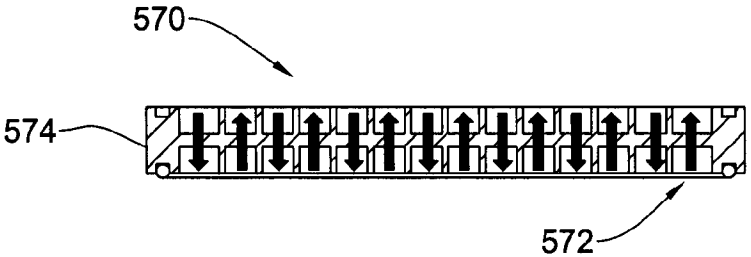
FIG. 13A is a cross-section of only the channel-forming block along the same plane as that of FIG. 12.
Figure 13C:
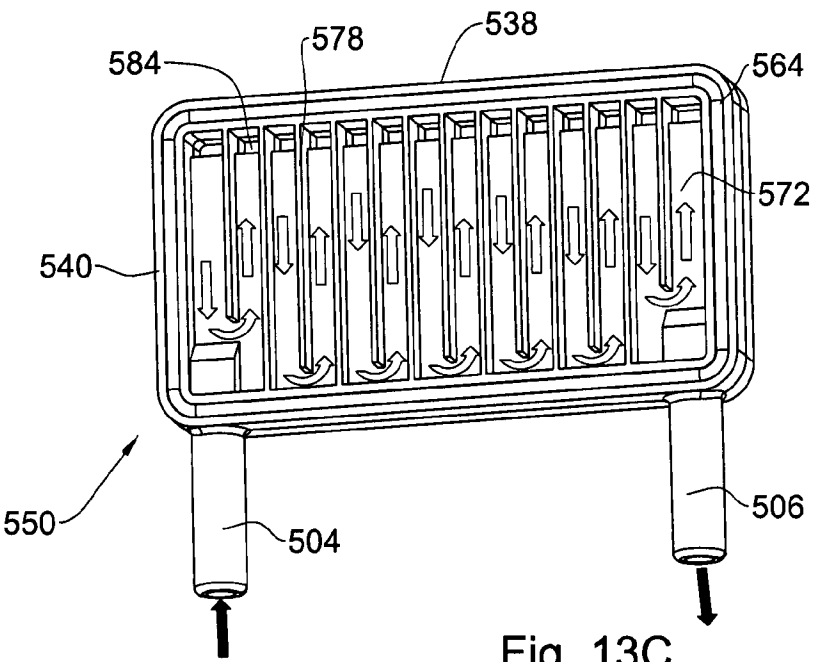
FIGS. 13B and 13C are perspective views of the channel-forming block, respectively depicting its faces pointed to by arrows B and C in FIG. 13A.
Figure 13B:
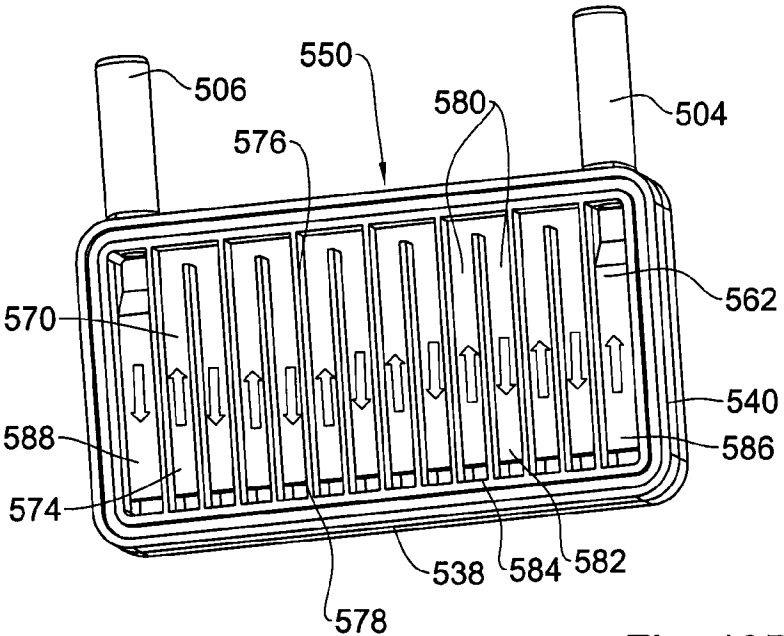

As can be seen in FIGS. 13A, 13B and 13C, block 550 is patterned on both its inner surfaces 570 and 572. Once fitted between heat conducting walls 534,536 the patterned surfaces define a 3-dimensional, curvilinear flow-path, which will be further detailed below.

Block 550 has a main divider panel 574, which essentially divides the chamber into two compartments at opposite sides of panel 574 between the panels and heat conducting walls 534,536. Extending from the main divider panel 574 towards the respective walls 534,536 are two arrays of auxiliary panels 576 and 578, the former extends from side wall 538 toward the opposite side wall leaving a clearance; and the latter extends fully between the side walls. These auxiliary panels pattern the inner surfaces of block 550 to define U-shaped channel segments 580, each with two ends 582 having each an opening 584 providing flow communication between the ends of U-shaped channel segments in the two faces of the block.

The 3-dimensional, serpentine flow-path so formed is shown by the arrows in FIGS. 13A-13C in a self explanatory manner. Thus, as can be seen, a flow-path of successive U-shaped channel segments is formed alternating between such segments in the two compartments.

Inlet 504 and outlet 506 are in flow communication with two respective end channel segments 586 and 588, which are linear (and not U-shaped) leading between the inlet and outlet to openings 584.

Figure 14A:
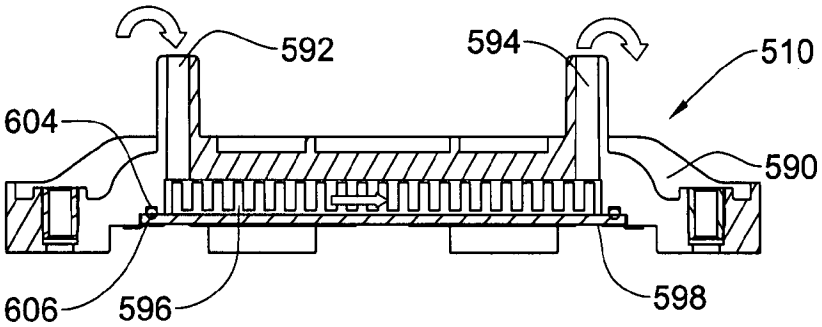
Figure 14B:
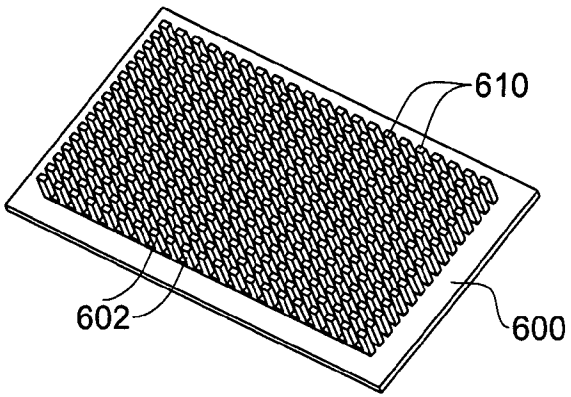
Figure 14C:
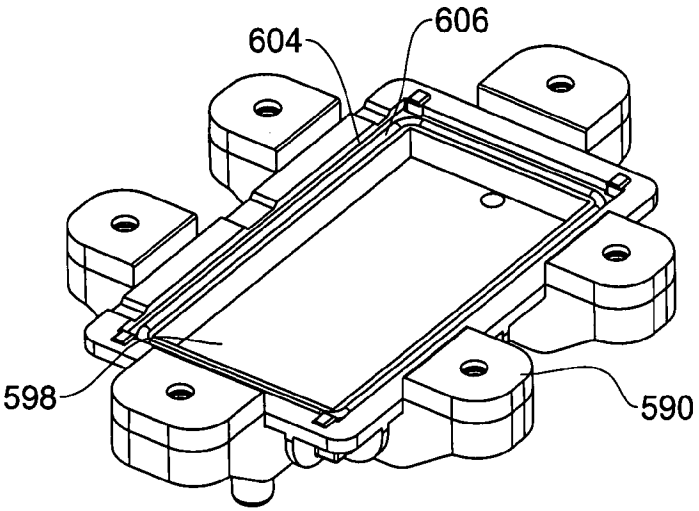

Reference is now made to FIGS. 14A-14C showing the heat absorption module 510 according to an embodiment of the invention (identical to module 512). The module comprises a block 590 that defines a coolant fluid inlet 592 and a coolant fluid outlet 594, which is in flow communication with lumen 596 defined by recess 598 in block 590 and panel 600 of metal block 602. Block 590 has a groove 604, tracing the circumference of recess 598, accommodating an O-ring 606 which cooperates with panel 600 to seal lumen 596 in a fluid-tight manner. Metal block 602, typically made of copper, includes a plurality of spikes 610 that provide a large heat exchange surface for the coolant liquid flowing through the lumen 596 as represented by the block arrow in FIG. 14A.

When assembled, as can be seen in FIG. 8, panel 600 bears against the external surface of Peltier elements 520, thereby transporting the generated heat to the spikes, which is then removed by the coolant fluid flowing into a refrigeration unit, for example of the kind shown in FIG. 1.

The invention claimed is:

1. A temperature control system for regulating temperature of a liquid as it flows through the system, comprising:

a first set of one or more temperature control elements oppositely disposed to a second set of one or more temperature control elements, said first and second sets defining between them a temperature control zone;

a heat-exchange chamber disposed in said temperature control zone and defined between a first heat-conducting wall disposed in heat conducting association with the first set of temperature control elements and a second heat conducting wall disposed in heat conducting association with the second set of temperature control elements, an arrangement of channels formed within the chamber defining one or more continuous flow paths within the chamber leading from a liquid inflow to a liquid outflow, the liquid flow path being configured so as the flow path has alternating first and second channels, such that a first group of one or more of said channels are adjacent to and in heat-conducting association with said first wall and a second group of one or more of said channels are adjacent to and in heat-conducting association with said second wall, wherein the heat-exchange chamber comprises a main divider panel disposed in between the two heat-conducting walls and extending essentially parallel thereto to divide the chamber into a first compartment adjacent the first wall and a second compartment adjacent the second wall; each of the compartments being divided by auxiliary panels extending from the main divider panel to the heat conducting walls and defining substantially U-shaped channel segments with two ends; there being opening formed in the main dividing panels to link ends of U-shaped channel segments in the first compartment with ends of a U-shaped channel segments in the second compartment to thereby form a flow path of the U-shaped channel segments from the inlet to the outlet.

2. The system of claim 1, wherein the flow path has a serpentine geometry.

3. The system of claim 1, wherein the temperature control elements are thermoelectric cooling elements.

4. The system of claim 3, wherein the thermoelectric cooling elements are planar Peltier elements with opposite cold and hot faces, the cold faces of the elements lining the temperature control zone.

5. The system of claim 4, comprising a first set of one or more Peltier elements disposed at one side of the temperature control zone and a second set of one or more Peltier element disposed at an opposite side of the temperature control zone.

6. The system of claim 1, wherein the channels are formed by dividing panels disposed within the chambers.

7. The system of claim 6, wherein at least some of the channels of the first group are alternatively arranged along the flow path with channels of the second group.

8. The system of claim 1, wherein the main divider panel, the auxiliary divider panels and the side walls are made from a single block of material.

9. The system of claim 1, wherein said temperature control elements are selected from thermoelectric elements and Peltier elements.

10. The system of claim 9, wherein the thermoelectric elements are associated with a heat sink arrangement for transport and dissipation of heat generated by said elements.

11. The system of claim 10, wherein the heat sink arrangement comprises a closed-circuit heat transport conduit system containing a coolant fluid fitted between a heat absorption module that is in a heat-transfer association with the one or more thermoelectric elements and a heat dissipation module.

12. A device for dispensing a temperature-controlled liquid, comprising a liquid cooling system of claim 1.

13. The device of claim 12, wherein the liquid is a beverage.

14. The device of claim 13, wherein the beverage is drinking water.

* * * * *